US008929773B2

(12) United States Patent
So

(10) Patent No.: US 8,929,773 B2
(45) Date of Patent: Jan. 6, 2015

(54) PROCESS CARTRIDGE

(75) Inventor: Kin Keung So, Guangdong (CN)

(73) Assignee: Print-Rite • Unicorn Image Products Co., Ltd. of Zhuhai, Zhuhai, Guangdong (CN)

( * ) Notice: Subject to any disclaimer, the term of this patent is extended or adjusted under 35 U.S.C. 154(b) by 192 days.

(21) Appl. No.: 13/203,128

(22) PCT Filed: Mar. 19, 2010

(86) PCT No.: PCT/CN2010/071162

§ 371 (c)(1),
(2), (4) Date: Aug. 24, 2011

(87) PCT Pub. No.: WO2010/108423

PCT Pub. Date: Sep. 30, 2010

(65) Prior Publication Data

US 2011/0305482 A1 Dec. 15, 2011

(30) Foreign Application Priority Data

Mar. 27, 2009 (CN) ..... 2009 2 0053735 U

(51) Int. Cl.
*G03G 15/08* (2006.01)
*G03G 21/18* (2006.01)

(52) U.S. Cl.
CPC ..... *G03G 21/1867* (2013.01)
USPC ..... 399/120

(58) Field of Classification Search
CPC ..... G03G 2215/0619; G03G 2215/0617; G03G 21/1867; G03G 21/1871
See application file for complete search history.

(56) References Cited

U.S. PATENT DOCUMENTS

| | | | | |
|---|---|---|---|---|
| 4,942,429 | A * | 7/1990 | Kakitani | 399/46 |
| 6,345,164 | B1 * | 2/2002 | Yokomori et al. | 399/119 |
| 6,415,127 | B1 * | 7/2002 | Yamamoto et al. | 399/284 |
| 7,072,603 | B2 * | 7/2006 | Tsuzuki et al. | 399/111 |
| 7,239,831 | B2 | 7/2007 | Hagiwara et al. | |
| 2009/0154942 | A1 * | 6/2009 | Hotogi et al. | 399/27 |

FOREIGN PATENT DOCUMENTS

| | | | | |
|---|---|---|---|---|
| CN | 101216694 | A | 7/2008 | |
| CN | 201116971 | | 9/2008 | |
| CN | 101334613 | A | 12/2008 | |
| JP | 61094074 | A * | 5/1986 | G03G 15/09 |
| JP | 2001356591 | A | 12/2001 | |

OTHER PUBLICATIONS

International Search Report dated Jun. 24, 2010.

* cited by examiner

*Primary Examiner* — Clayton E Laballe
*Assistant Examiner* — Victor Verbitsky
(74) *Attorney, Agent, or Firm* — Cozen O'Connor

(57) ABSTRACT

A process cartridge used in an image forming apparatus, the process cartridge having a photosensitive drum, a developer roller, a conductive electrode and a rectifier. The photosensitive drum and the developer roller are contacted with each other. The conductive electrode is contacted with a power supply electrode in the image forming apparatus to receive a developing bias. The rectifier converts an alternating current bias voltage into a direct current bias voltage. The rectifier is electrically connected between the conductive electrode and the developer roller. A rectifier converting an alternating current bias voltage into a direct current bias voltage is added into a contact process cartridge in the present invention. Therefore, the contact process cartridge can be applied to a printer using a jumping development method.

22 Claims, 4 Drawing Sheets

PROCESS CARTRIDGE

CROSS-REFERENCE TO RELATED APPLICATIONS

This application claims priority from international application No. PCT/CN2010/071162 filed on Mar. 19, 2010, which claims priority from Chinese Patent Application Number 200920053735.5 filed on Mar. 27, 2009. These applications are incorporated herein by reference.

FIELD OF THE INVENTION

The present invention relates to process cartridges applying electrophotographic technology, which are mainly used in printers and other image forming apparatus.

BACKGROUND OF THE INVENTION

Generally, a process cartridge applying electrophotographic technology comprises at least: a photosensitive drum on which an electrostatic latent image is formed and a developer roller which provides developer on the photosensitive drum to develop the electrostatic latent image. Its image forming mechanism can be roughly described as follows: an electrostatic latent image is formed on a photosensitive drum through an exposure unit such as a laser scan unit corresponding to a digital image signal, the electrostatic latent image is developed through the developer provided from a developer roller, the developed image is transferred onto a recording medium, and the transferred image is fixed on a recording medium through heat and pressure thus to form an image.

A process cartridge is generally divided into a contact process cartridge and a non-contact process cartridge according to whether a photosensitive drum and a developer roller are separated with each other for a predetermined gap. In a contact process cartridge, a photosensitive drum and a developer roller are contacted with each other. A printer exerts a direct current bias voltage on the developer roller. A developer is moved from the developer roller to the photosensitive drum through voltage difference between the photosensitive drum and the developer roller. This type of the development is called a contact development method.

In a non-contact process cartridge, a photosensitive drum and a developer roller are separated with each other for a predetermined gap. A printer exerts a direct current bias voltage and an alternating current bias voltage in an overlapping mode. A developer jumps onto the photosensitive drum from the developer roller. This type of the development is called a jumping development method.

Since bias voltages exerted to developer rollers are different in a contact development method and a jumping development method, the process cartridges of these two development methods can only be used with correspondent printers and cannot universally be used. That is, a contact process cartridge cannot be used in a jumping development printer while a jumping development cartridge can also not be used in a contact development printer.

Currently, there is a process cartridge applying a jumping development method. Its structure is shown in FIG. 1. The process cartridge comprises a toner chamber component 20' and a waste toner chamber component 30' that are connected into an integral one through a connection shaft. The toner chamber component 20' comprises a toner chamber 1', a magnetic toner 2', an agitator 3', a magnetic roller component 4' and a toner deposit blade 5'. The waste toner chamber component 30' comprises a waste toner chamber 7', a photosensitive drum 6', a cleaning blade 8' and a charge roller 9'. Compression springs 10' are provided at the two ends of the toner chamber 1', respectively. The waste toner chamber component 30' is stuck together with the toner chamber component 20' through spring action of the compression springs 10'. The gap between the magnetic roller component 4' and the photosensitive drum 6' can be ensured through the interval sets at the two ends of the magnetic roller component 4'. The development mechanism is described as follows: after the magnetic toner 2' is mixed evenly through the agitator 3' in the toner chamber 1', it is carried by a doping vehicle and absorbed on the outer surface of the magnetic roller component 4' by the permanent core of the magnetic roller component 4', at this moment, the magnetic toner 2' does not show any polarity. That the magnetic roller component 4' carrying the magnetic toner 2' rotates and is tangent and makes friction to the toner deposit blade 5' causes the magnetic toner 2' to take charge. The magnetic toner 2' forms a very thin and evenly distributed layer of the magnetic toner on the surface of the magnetic roller component 4' under the action of the toner deposit blade 5' and the magnetic field. When the photosensitive drum 6' having formed an electrostatic latent image closes to a certain distance from the carried magnetic toner 2' through the magnetic roller component 4', the magnetic toner 2' jumps to the surface of the photosensitive drum 6' to form a toner image under the action of developing bias formed by overlapping an alternating current bias voltage and a direct current bias voltage. The photosensitive drum 6' carrying the toner image acts together with a printer's transfer roller causing the toner image to be printed on a printing paper and then to enter into a fixing system, so does the cycle.

The printing quality of this development method is to control the distance between the photosensitive drum 6' and the magnetic roller component 4' mainly through the thickness of the interval sets at the end of the magnetic toner 2'. Especially under the working condition, the photosensitive drum 6' and the magnetic roller component 4' are all exited in rotating states. The jump of the photosensitive drum 6' and the magnetic roller component 4' can easily change the distance between the photosensitive drum 6' and the magnetic roller component 4'. So, in order to ensure good printing quality, little change of the distance between the photosensitive drum 6' and the magnetic roller component 4' is required. The precise accuracy is required to be 0.01. The accuracy of the cartridge parts is so high that it causes the manufacturing cost to be very high.

SUMMARY OF THE INVENTION

The technical problem to be solved by the present invention is to provide a contact process cartridge capable of applying in a printer or an image forming apparatus using a jumping development method, reducing the manufacturing accuracy requirement of the process cartridge parts and thus reducing the manufacturing cost and improving printing quality.

To solve the above technical problem, the technical program employed in the present invention is to provide a process cartridge comprising a toner chamber component and a waste toner chamber component connected with each other, wherein the toner chamber component comprises a developer roller and the waste toner chamber component comprises a photosensitive drum and said developer roller is contacted with the photosensitive drum; and a conductive electrode capable of contacting with a power supply electrode of the image forming apparatus to receive a developing bias. The conductive electrode is electrically connected to said developer roller, in which a rectifier is provided on the process cartridge for converting an alternating current bias voltage from said power supply electrode into a direct current bias voltage. The rectifier is electrically connected between said conductive electrode and the developer roller.

According to a process cartridge of the present invention, said rectifier can be provided at the end of the process cartridge, such as the end of the toner chamber component.

According to a process cartridge of the present invention, there is a toner supply roller used for providing developer to a developer roller inside the toner chamber.

A rectifier is added on a contact developing process cartridge to convert an alternating current bias voltage of a power supply electrode in an image forming apparatus into a direct current bias voltage in the present invention. The rectifier is electrically connected between a conductive electrode and a developer roller in the process cartridge. Thus, the contact process cartridge can be used in a printer with jumping development method. This printer usually exerts a direct current bias voltage and an alternating current bias voltage on the developer roller in an overlapping mode. Since there is no gap between the photosensitive drum and the developer roller in the contact process cartridge, it is not required to accurately ensure the gap between the photosensitive drum and the developer roller. Thus, the manufacturing cost of the process cartridge is reduced and the printing quality is improved. The above contact process cartridge can be transformed from a jumping process cartridge.

DETAILED DESCRIPTION OF THE PRESENTLY PREFERRED EMBODIMENTS

The present invention is further described below in conjunction with each embodiment and figures.

Figure 1:
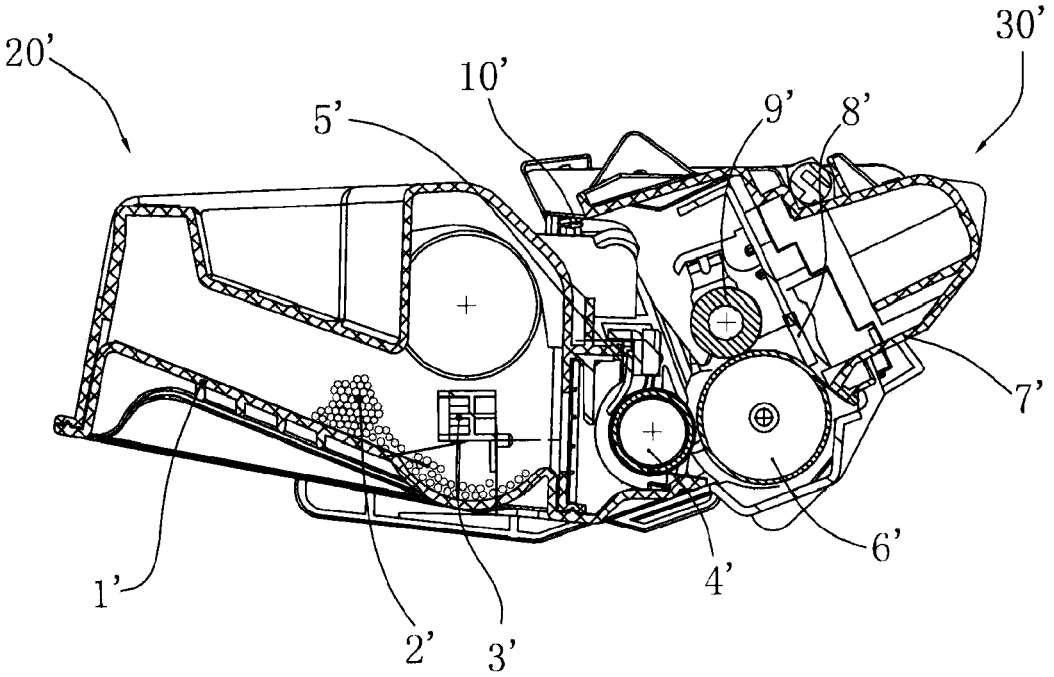
FIG. 1 is a sectional view illustrating a current jumping process cartridge.
Figure 2:
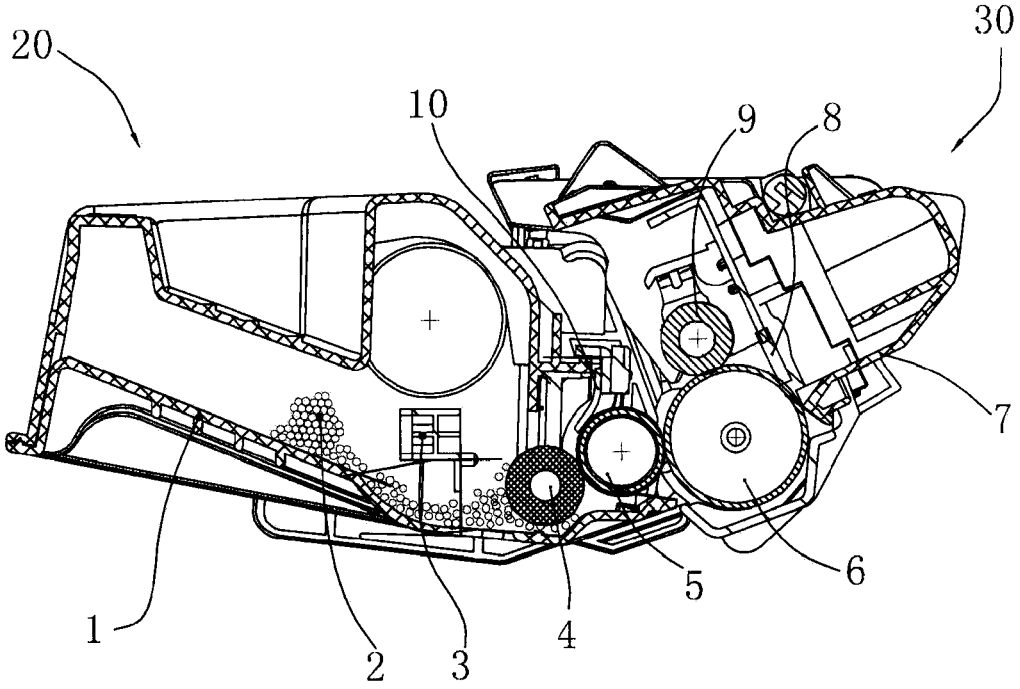
FIG. 2 is a sectional view illustrating an embodiment of a contact process cartridge in the present invention.
Figure 3:
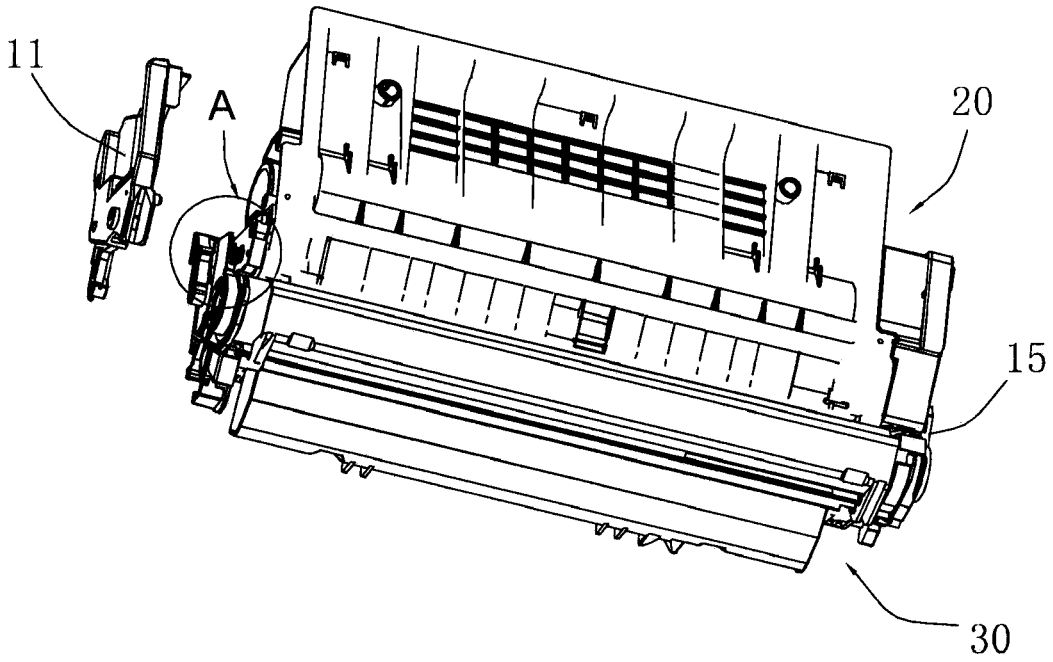
FIG. 3 is a perspective view of the overall structure of the contact process cartridge shown in FIG. 2.

Referring to FIG. 2 and FIG. 3, a process cartridge of the present invention comprises a toner chamber component 20 and a waste toner chamber component 30. The toner chamber component 20 comprises a toner chamber 1, a non-magnetic toner 2, an agitator 3, a toner supply roller 4, a developer roller 5 and a toner deposit blade 10, etc. The waste toner chamber component comprises a waste toner chamber 7, a photosensitive drum 6, a cleaning blade 8 and a charge roller 9, etc. The process cartridge is an integral one in which the toner chamber component 20 and the waste toner chamber 30 component are connected through a connection shaft. A gear cover 15 and a conductive-end end cover 11 are provided at the two ends of the process cartridge, respectively, which makes the developer roller 5 to keep enough contact with the photosensitive drum 6. Since there is no gap between the photosensitive drum 6 and the developer roller 5, it is not required to accurately ensure the gap between the photosensitive drum 6 and the developer roller 5.

Figure 4:
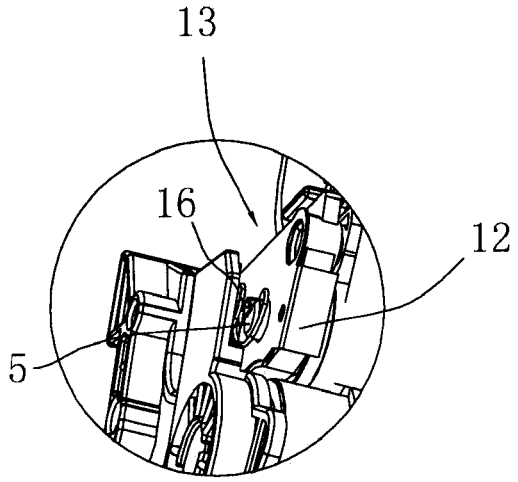
FIG. 4 is a partial enlarged view of A shown in FIG. 3.
Figure 5:
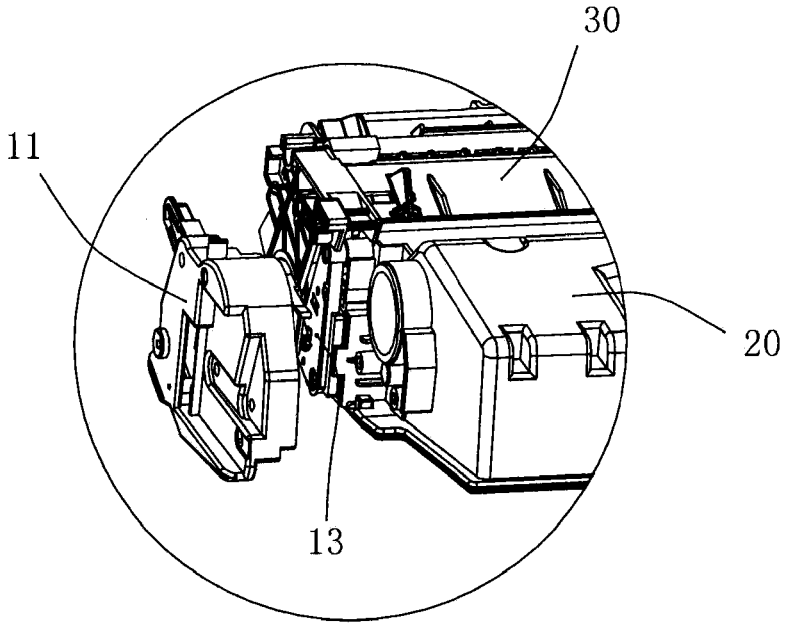
FIG. 5 is a partial perspective view of a conductive end part of the contact process cartridge shown in FIG. 2.
Figure 6:
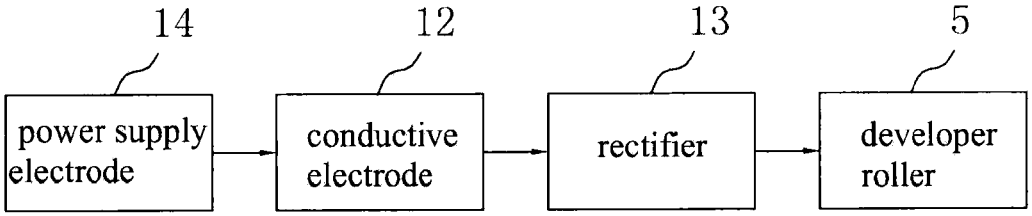
FIG. 6 is a perspective view illustrating an electrical connection of the developing bias of the contact process cartridge shown in FIG. 2.

Referring to FIG. 4-FIG. 6, a conductive electrode 12 and a rectifier 13 are provided on the process cartridge. The rectifier 13 is connected between the conductive electrode 12 and the developer roller 5. The rectifier 13 can be fixed between the conductive-end end cover 11 at the end of the process cartridge and the body of the process cartridge (For example, fixed at the end of the toner chamber component 20). The conductive electrode 12 can be provided on the rectifier 13. It can also be provided on the conductive-end end cover 11 or other parts of the process cartridge as long as it can be ensured to contact the power supply electrode 14 in a printer and other image forming apparatus using jumping development methods and receive a developing bias. The conductive electrode 12 can electrically be connected to an internal circuit of the rectifier 13 through a conductive film, a wire or any other conductors. After the internal circuit inside the rectifier converts an alternating current bias voltage of the power supply electrode 14 in the printer imported through the conductive electrode 12 into a direct current bias voltage, the direct current bias voltage is provided to the developer roller 5 through an electric contact film 16.

The working mechanism of the above process cartridge is: after the non-magnetic toner 2 is agitated evenly through the agitator 3 inside the toner chamber 1, the non-magnetic toner 2 and the developer roller 5 rubs against each other through transport and delivery of the toner supply roller 4, making the non-magnetic toner 2 to take charge and to be adsorbed on the outer surface of the developer roller 5. When the developer roller 5 carrying the charged non-magnetic toner 2 rotates, and is tangent and makes friction to the toner deposit blade 10, the amount of electrical charge of the non-magnetic toner 2 is increased. Under the action of the toner deposit blade 10, the non-magnetic toner 2 forms a very thin and evenly distributed non-magnetic toner layer on the surface of the developer roller 5. When the photosensitive drum 6 having formed an electrostatic latent image closes a certain distance to the developer roller 5 carrying the non-magnetic toner 2, the non-magnetic toner 2 can rotate to the surface of the photosensitive drum 6 to form a toner image under the action of the direct current field. The photosensitive drum 6 having the toner image acts in common with the transfer roller in the printer, causing the toner image to be transferred on a printing paper and then enter into a fixing system, as the cycle like this.

INDUSTRIAL APPLICABILITY

A rectifier is added on a contact process cartridge to convert an alternating current bias voltage into a direct current bias voltage in the present invention. The rectifier is electrically connected between a conductive electrode and a developer roller in the process cartridge. Thus, the contact process cartridge can be used in a printer with a jumping development method. This printer usually exerts a direct current bias voltage and an alternating current bias voltage on the developer roller in an overlapping mode. Since there is no gap between a photosensitive drum and the developer roller in the contact process cartridge, it is not required to accurately ensure the gap between the photosensitive drum and the developing roller. Thus, the manufacturing cost of the process cartridge is reduced and the printing quality is improved. The above contact process cartridge can be transformed from a jumping process cartridge.

What is claimed is:

1. A contact process cartridge adapted for use with a jumping development image forming apparatus, the contact process cartridge comprising:

a toner chamber component and a waste toner chamber component connected with each other, wherein the toner chamber component comprises a developer roller, the waste toner chamber component comprises a photosensitive drum, and said developer roller contacting said photosensitive drum; and a conductive electrode in communication with an alternating current power supply electrode in the jumping development image forming apparatus to receive an alternating current developing bias voltage, wherein the conductive electrode is electrically connected to said developer roller, wherein a rectifier is provided on said contact process cartridge to convert the alternating current bias voltage from said alternating current power supply electrode into a direct current bias voltage, and wherein the rectifier is electrically connected between said conductive electrode and said developer roller, and the direct current bias voltage is applied to said developer roller.

2. The contact process cartridge according to claim 1, wherein, a toner supply roller is provided inside said toner chamber component to supply developer to said developer roller.

3. The contact process cartridge according to claim 1, wherein, said rectifier is provided at an end of the contact process cartridge.

4. The contact process cartridge according to claim 3, wherein, a toner supply roller is provided inside said toner chamber component to supply developer to said developer roller.

5. The contact process cartridge according to claim 1, wherein, said rectifier is provided at the end of said toner chamber component.

6. The contact process cartridge according to claim 5, wherein, a toner supply roller is provided inside said toner chamber component to supply developer to said developer roller.

7. The contact process cartridge according to claim 5, wherein, said conductive electrode is provided on said rectifier.

8. The contact process cartridge according to claim 7, wherein, a toner supply roller is provided inside said toner chamber component to supply developer to said developer roller.

9. The contact process cartridge according to claim 5, wherein, said conductive electrode is provided on a conductive-end end cover at one end of the contact process cartridge.

10. The contact process cartridge according to claim 9, wherein, a toner supply roller is provided inside said toner chamber component to supply developer to said developer roller.

11. A contact process cartridge adapted for use with a jumping development image forming apparatus, the contact process cartridge comprising:

a developer roller and a photosensitive drum, said developer roller positioned to contact said photosensitive drum; and a conductive electrode in communication with an alternating current power supply electrode in the jumping development image forming apparatus to receive an alternating current developing bias voltage, the conductive electrode being electrically connected to said developer roller, wherein, a rectifier is provided on said contact process cartridge to convert the alternating current bias voltage received by the conductive electrode into a direct current bias voltage, wherein the conductive electrode is electrically connected to said developer roller via the rectifier, and the direct current bias voltage is applied on said developer roller.

12. The contact process cartridge according to claim 11, wherein, a toner supply roller is provided inside the contact process cartridge to supply developer to said developer roller.

13. The contact process cartridge according to claim 11, wherein, a non-magnetic toner is provided in the contact process cartridge.

14. The contact process cartridge according to claim 11, wherein, said rectifier is provided at an end of the contact process cartridge.

15. The contact process cartridge according to claim 14, wherein, a toner supply roller is provided inside the contact process cartridge to supply developer to said developer roller.

16. The contact process cartridge according to claim 14, wherein, a non-magnetic toner is provided in the contact process cartridge.

17. The contact process cartridge according to claim 14, wherein, said conductive electrode is provided on said rectifier.

18. The contact process cartridge according to claim 17, wherein, a toner supply roller is provided inside the contact process cartridge to supply developer to said developer roller.

19. The contact process cartridge according to claim 17, wherein, a non-magnetic toner is provided in the contact process cartridge.

20. The contact process cartridge according to claim 14, wherein, said conductive electrode is provided on a conductive-end end cover of the contact process cartridge.

21. The contact process cartridge according to claim 20, wherein, a toner supply roller is provided inside the contact process cartridge to supply developer to said developer roller.

22. The contact process cartridge according to claim 20, wherein, a non-magnetic toner is provided in the contact process cartridge.

* * * * *